US006660971B2

(12) United States Patent
Terada et al.

(10) Patent No.: US 6,660,971 B2
(45) Date of Patent: Dec. 9, 2003

(54) HEATER AND GLOW PLUG

(75) Inventors: Naoto Terada, Nagoya (JP); Kouji Okuda, Aichi (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 10/155,228

(22) Filed: May 28, 2002

(65) Prior Publication Data

US 2002/0175157 A1 Nov. 28, 2002

(30) Foreign Application Priority Data

May 28, 2001 (JP) ..... P.2001-158163

(51) Int. Cl.[7] ..... F23Q 7/00

(52) U.S. Cl. ..... 219/270; 361/266; 123/145 A; 313/141

(58) Field of Search ..... 361/264, 265, 361/266; 219/270, 544; 123/145 A, 145 R, 143 C; 313/118, 141, 142

(56) References Cited

U.S. PATENT DOCUMENTS 4,661,686 A * 4/1987 Yokoi et al. ..... 219/270
5,039,839 A * 8/1991 Masaka et al. ..... 219/270
6,046,434 A * 4/2000 Locher et al. ..... 219/270
6,064,039 A * 5/2000 Kumada ..... 219/270
6,215,105 B1 * 4/2001 Simpkins et al. ..... 219/270
6,248,980 B1 * 6/2001 Chiu et al. ..... 219/270
6,285,007 B1 * 9/2001 Chiu et al. ..... 219/270
6,437,493 B2 * 8/2002 Nasu et al. ..... 313/141
6,465,759 B1 * 10/2002 Simpkins et al. ..... 219/270

FOREIGN PATENT DOCUMENTS

JP 2762385 B2 3/1998
JP 11-94253 4/1999
JP 2000-97434 4/2000

* cited by examiner

*Primary Examiner*—Teresa Walberg
*Assistant Examiner*—Fadi H. Dahbour
(74) *Attorney, Agent, or Firm*—Morgan, Lewis & Bockius LLP

(57) ABSTRACT

A heater comprising: a cylindrical metal shell having an engagement portion, the portion having a narrowed diameter; a cylindrical heating tube comprising a closed top end, a fitting portion, a smaller diameter portion, a base end side-larger diameter portion and a top end side-larger diameter portion, wherein a base end of the heating tube protrudes into an inside of the metal shell, the fitting portion is fitted into the engagement portion in interference fit, the smaller diameter portion comprises the base end of the heating tube, the smaller diameter portion has a smaller outer diameter than an inner diameter of the engagement portion, the base end side-larger diameter portion is formed between the fitting portion and the smaller diameter portion, the base end side-larger diameter portion has an outer diameter larger than or equal to the inner diameter of the engagement portion, the top end side-larger diameter portion is formed adjacent to a top end side of the fitting portion, and the top end side-larger diameter portion has an outer diameter larger than or equal to the inner diameter of the engagement portion.

10 Claims, 5 Drawing Sheets

HEATER AND GLOW PLUG

FIELD OF THE INVENTION

The present invention relates to a heater for heating a heating object such as the gas or liquid, and a glow plug for the diesel engine.

BACKGROUND OF THE INVENTION

The conventional heater will be described below by way of example for a glow plug with reference to FIG. 5. This glow plug 100 is roughly made up of a cylindrical metal shell 101, a heating tube 102 that is cylindrical and has a uniform thickness with a top end cloned, the heating tube 102 fitted inside the metal shell 101, and a center electrode 103 of round pole type. The center electrode 103 is passed through the center of the metal shell 101 to reach the heating tube 102, in which the closed top end of the heating tube 102 and the top end of the center electrode 103 are electrically connected via a heating coil 104. The metal shell 101 has an engagement portion 105 with an aperture (diameter) restricted (narrowed), and the heating tube 102 is fitted into the engagement portion 105 in interference fit. A rear end side of the heating tube 102 is passed through the engagement portion 105 of the metal shell 101 to protrude into the inside of the metal shell 101.

One of the universal technical themes for the glow plug is a reduction in size and weight. For this purpose, it is indispensable that the outer diameter of the heating tube 102 is reduced. At present, the heating tube 102 having a diameter of 3.5 mm has been developed. The technical theme for reducing the size and weight generally applies to all the heaters.

SUMMARY OF THE INVENTION

If the heating tube 102 is made slender, the strength is lowered, resulting in a high risk that the heating tube 102 is bent when press fitted into the engagement portion 105 of the metal shell 101. Also, in the case where the heating tube 102 having a uniform thickness is press fitted into the engagement portion 105 of the metal shell 101, it is required that the heating tube 102 starts to be press fitted from the time when the rear end of the heating tube 102 enters the engagement portion 105, and continues to be press fitted even after the rear end of the heating tube 102 gets out of the engagement portion 105. Accordingly, the heating tube 102 is pushed into the inside of the metal shell 101 by a long distance, while being press fitted, whereby the press-fit load is likely to be great. Since there are many sections of the heating tube 102 contributing to (or involving) the press fitting, there is a great dispersion in press-fit load of the heating tube 102, which is caused by variations in frictional force occurring with the engagement portion 105 of the metal shell 101, resulting in poor controllability for the heating tube 102. The magnitude of dispersion in press-fit load has been confirmed through the test of fitting the heating tube having a uniform thickness into the metal shell, as conducted by the present applicant. This dispersion in press-fit load makes it difficult to control the automatic fitting device for the heating tube 102, developing a factor of aggravating the product accuracy.

In recent years, a glow plug is well known in which the heating tube has a two stage structure of a larger diameter portion on the base end side and a smaller diameter portion on the top end side to attain a temperature up performance at the early time, and the larger diameter portion of the heating tube is fitted into the engagement portion of the metal shell in interference fit. However, in the glow plug with this constitution, the press-fit load for the heating tube into the metal shell is likely to increase, because the outer diameter of the larger diameter portion is uniform in thickness. In fitting the heating tube having the two stage structure into the metal shell, in the case where it is designed to allow a part of the smaller diameter portion to be entered to a position of the engagement portion in the metal shell, the following problem arises, even though the heating tube is fitted into the metal shell. That is, since there is a section at the top end portion of the engagement face in the engagement portion not contributing to an interference fit with the heating tube (smaller diameter portion), if the glow plug drops in a process for manufacturing the glow plug or mounting it on the engine to exert a strong impact force toward the base end side of the heating tube from the outside, the heating tube is deviated toward the base end side of the metal shell, or gets rid of the metal shell by any chance.

The present invention has been achieved in the light of the above-mentioned problems, and it is an object of the invention to provide a heater and a glow plug that are highly reliable, in which the press-fit load for the heating tube into the metal shell is suppressed from increasing more than needed, without significant resistance in passage through the engagement portion at the early time of fitting the heating tube into the metal shell.

According to one embodiment of the present invention, there is provided a heater having a cylindrical metal shell formed with an engagement portion having a restricted aperture, and a cylindrical heating tube with a top end side closed to be fitted into the engagement portion in interference fit, in which a base end side of the heating tube is passed through the engagement portion to protrude into the inside of the metal shell, the heating tube comprising a fitting portion that is fitted into the engagement portion formed in the metal shell, a smaller diameter portion formed containing an end portion on the base end side protruding into the inside of the metal shell and having a smaller outer diameter than an inner diameter of the engagement portion, a large diameter portion on the base end side formed between the fitting portion and the smaller diameter portion and having an outer diameter larger than or equal to the inner diameter of the engagement portion, and a larger diameter portion on the top end side formed adjacent to a top end side of the fitting portion and having an outer diameter larger than or equal to the inner diameter of the engagement portion. Also, this invention provides a glow plug of the same structure in which the use of the heater is limited to starting aids of the diesel engine.

Description of Reference Numerals and Signs

Figure 1:
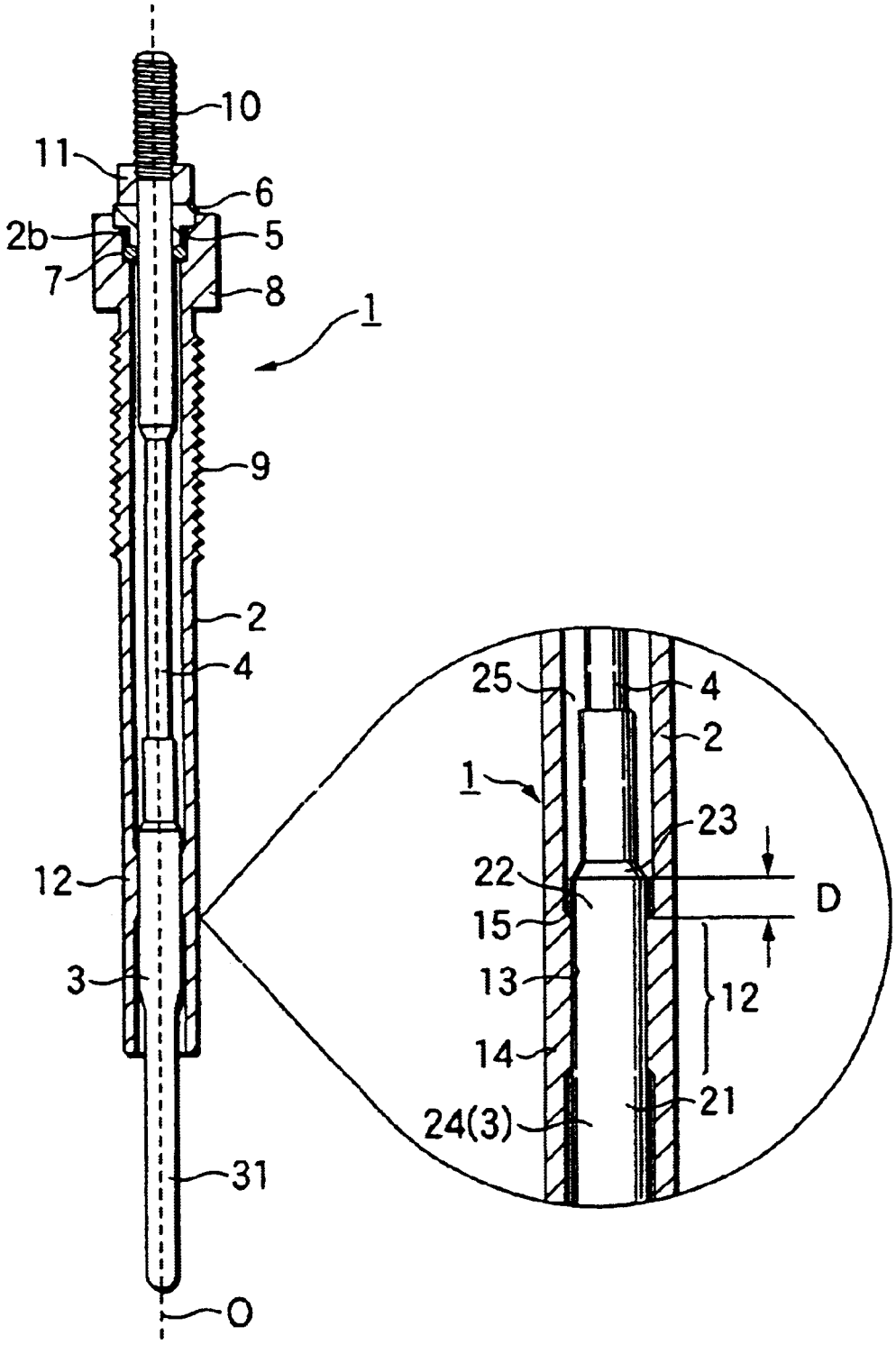
FIG. 1 is a cross-sectional view of a glow plug.

1 . . . glow plug (heater)
2 . . . metal shell
3 . . . heating tube
12 . . . engagement portion
13 . . . engagement face
14 . . . top end
15 . . . base end
21 . . . fitting portion
22 . . . base end side-larger diameter portion
23 . . . smaller diameter portion
24 . . . top end side-larger diameter portion
25 . . . end portion on base end side

DETAILED DESCRIPTION OF THE INVETION

In the heater or glow plug of the structure in which the heating tube is fitted into the engagement portion of the metal shell in interference fit (press fit), it is important that the length of the heating tube contributing to press fitting is limited to be constant for each product number or product lot. For this reason, unless the length of the heating tube contributing to press fitting is kept by a constant value, the joint strength of press fitting the heating tube into the metal shell may not be obtained. Thus, in this invention, the length of the heating tube contributing to press fitting is controlled in the engagement portion of the metal shell. Specifically, the length from the top end of the engagement face in the engagement portion to the base end is adjusted, and the heating tube is fitted from the top end of the engagement face to the base end in interference fit. Thereby, with the heater or glow plug of this invention, the fitting strength of the heating tube into the metal shell (engagement portion) in interference fit can be made excellent, whereby the reliable heater or glow plug can be produced.

In order to attain the fitting strength of the heating tube into the metal shell (engagement portion) in interference fit, when the outer diameter of a portion of the heating tube fitted into the engagement portion formed in the metal shell is from 3.5 to 7.0 mm, the length from the top end of the engagement face in the engagement portion to the base end is preferably set at 4.0 mm or greater.

And the heater or glow plug of this invention has a structure in which the fitting portion of the heating tube in press fitted into the metal shell from the top end to the base end of the engagement face in the engagement portion formed in the metal shell. It is to be noted that the heating tube in a state where it is fitted into the metal shell is formed containing the end portion on base end side protruding into the inside of the metal shell, and has the smaller diameter portion having the outer diameter smaller than the inner diameter of the engagement portion, the base end side-larger diameter portion formed between the fitting portion and the smaller diameter portion and having the outer diameter greater than or equal to the inner diameter of the engagement portion, and the top end side-larger diameter portion formed adjacent to the top end side of the fitting portion and having the outer diameter greater than or equal to the inner diameter of the engagement portion. In this manner, if the smaller diameter portion formed containing the end portion on base end side that is on the insertion side of the heating tube in inserting (press fitting) the heating tube into the metal shell has the outer diameter smaller than the inner diameter of the engagement portion, there is little resistance in passage of the heating tube through the engagement portion at the early time of fitting the heating tube into the engagement portion of the metal shell. Accordingly, the press-fit load for the heating tube into the metal shell is prevented from increasing more than needed, and when the heating tube is slender, the heating tube can be suppressed from being bent, whereby there is a reduced dispersion in press-fit load for the heating tube.

In this heating tube, the top end side-larger diameter portion and the base end side-larger dieter portion having the outer diameter greater than or equal to the inner diameter of the engagement portion are provided adjacent to the top end side and the base end side of the fitting portion fitted into the engagement portion formed in the metal shell, respectively. Therefore, in the process of producing or fitting the heater (glow plug) and when in use, the heating tube fitted into the engagement portion is effectively kept from being deviated to the top end side or base end side upon an impact from the outside, whereby the reliability of the heater (glow plug) can be increased. Furthermore, if the outer diameters of the top end side-larger diameter portion and the base end side-larger diameter portion are greater than the inner diameter of the engagement portion, the effect of suppressing the misregistration can be remarkably increased. Though the outer diameters of the top end side-larger diameter portion and the base end side-larger diameter portion can be preset to be greater than the outer diameter of the fitting portion, the outer diameters of the top end side-larger diameter portion and the base end side-larger diameter portion may be preset at an equal value to the outer diameter of the fitting portion, and the fitting portion of the heating tube may be caulked in the engagement portion of the metal shell, after the heating tube is inserted into the metal shell to provide a diameter difference.

Also, in the heater or glow plug according to the invention, the larger diameter portion on the base end side formed in the heating tube is disposed, inside the metal shell, preferably in an area with an axial length of 2 mm or less in the axial direction from the base end of the engagement face in the engagement portion to the base end side of the heating tube. In this manner, the position at which the base end side-larger diameter portion having an outer diameter greater than or equal to the inner diameter of the engagement portion formed in the metal shell is disposed is set within the specific area with reference to the base end of the engagement face in the engagement portion, whereby the press fitting time and distance for fitting the heating tube into the engagement portion of the metal shell can be shortened to the minimum as needed, with less dispersion in the frictional force occurring with the engagement portion. Consequently, the dispersion in the press-fit load for the heating tube can be reduced.

Moreover, in the heater or glow plug according to this invention, a diameter difference between the inner diameter of the engagement portion formed in the metal shell and the outer diameter of the end portion on the base end side in the smaller diameter portion of the heating tube preferably lies in a range from 0.02 to 0.5 mm. If this diameter difference is below 0.02 mm, the smaller diameter portion cannot be smoothly inserted into the engagement portion of the metal shell, and there is less effect of reducing the resistance in passage of the heating tube through the engagement portion of the metal shell at the early time of fitting the heating tube into the engagement portion of the metal shell. On the other hand, if the diameter difference is above 0.5 mm, the smaller diameter portion is likely to be eccentric with respect to the axis of the metal shell in fitting the heating tube into the engagement portion of the metal shell. Due to this eccentricity, the press-fit load is rather excessive after the insertion of the smaller diameter portion, giving rise to a risk that the heating tube is deformed. The diameter difference is preferably in a range from 0.02 to 0.3 mm.

According to another embodiment of the invention, there is provided a heater or a glow plug having a cylindrical metal shell formed with an engagement portion having a restricted aperture, and a cylindrical heating tube with a top end side closed to be fitted into the engagement portion in interference fit, in which a base end side of the heating tube is passed through the engagement portion to protrude into the inside of the metal shell, the heating tube comprising a fitting portion that is fitted into the engagement portion formed in the metal shell, a smaller diameter portion formed containing an end portion on the base end side protruding into the inside of the metal shell and having a smaller outer diameter than an inner diameter of the engagement portion, and a larger diameter portion on the top end side formed adjacent to a top end side of the fitting portion and having an outer diameter larger than or equal to the inner diameter of the engagement portion, wherein a diameter difference between the inner diameter of the engagement portion and the outer diameter of the end portion on the base end side in the smaller diameter portion lies in a range from 0.02 to 0.5 mm. Also, this invention provides a glow plug of the same structure in which the use of the heater is limited to starting aids of the diesel engine.

In this manner, the smaller diameter portion formed containing the end portion on base end side that is on the insertion side of the heating tube in inserting (press fitting) the heating tube into the inside of the metal shell has the smaller outer diameter than the inner diameter of the engagement portion, and the diameter difference between the inner diameter of the engagement portion and the outer diameter of the end portion on base end side in the smaller diameter portion is set in a range from 0.02 to 0.5 mm, whereby there is little resistance in passage through the engagement portion at the early time of fitting the heating tube into the engagement portion of the metal shell. Accordingly, the press-fit load for the heating tube into the metal. shell. is prevented from increasing more than needed, and when the heating tube is slender, the heating tube can be suppressed from being bent, whereby there is a reduced dispersion in press-fit load for the heating tube. Also, the heating tube is suppressed from being eccentric with respect to the central axis of the metal shell, and the product quality can be stabilized.

Herein, if this diameter difference is below 0.02 mm, the smaller diameter portion is smoothly inserted into the engagement portion of the metal shell with difficulties, and there is less effect of reducing the resistance in passage of the heating tube through the engagement portion of the metal shell at the early time of fitting the heating tube into the engagement portion of the metal shell. On the other hand, if the diameter difference is above 0.5 mm, the smaller diameter portion is likely to be eccentric with respect to the axis of the metal shell in fitting the heating tube into the engagement portion of the metal shell. Due to this eccentricity, the press-fit load is rather excessive, giving rise to a risk that the heating tube is deformed. The diameter difference is preferably in a range from 0.02 to 0.3 mm. Furthermore, the heating tube of this invention is provided with the top end side-larger diameter portion having the outer diameter greater than or equal to the inner diameter of the engagement portion in the form adjacent to the top end side of the fitting portion that is fitted into the engagement portion formed in the metal shell, in the process of producing or fitting the heater (glow plug) and when in use, the heating tube fitted into the engagement portion is effectively kept from being deviated to the base end side upon an impact from the outside, whereby the reliability of the heater (glow plug) can be increased.

EXAMPLES

Figure 2:
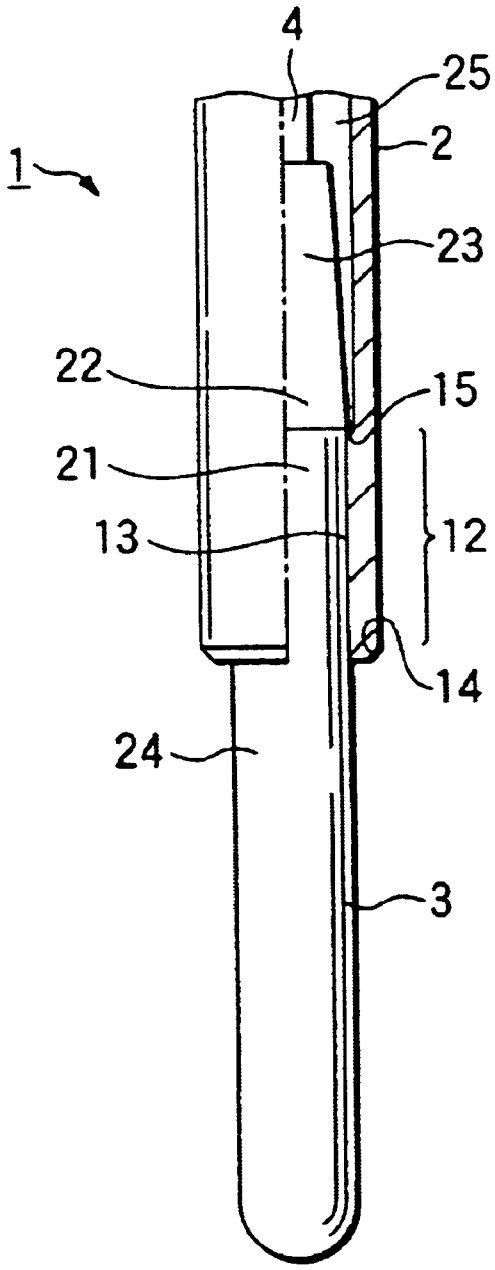
FIG. 2 is a front view, partly in cross section, of the essence of a heating tube according to an embodiment of the invention.
Figure 3:
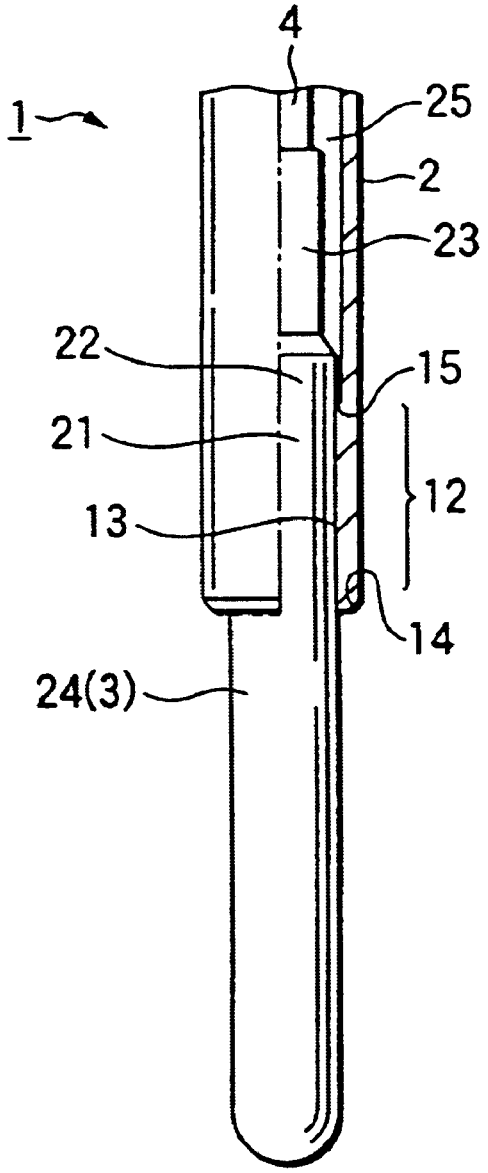
FIG. 3 is a front view, partly in cross section, of the essence of a heating tube according to an embodiment of the invention.
Figure 4:
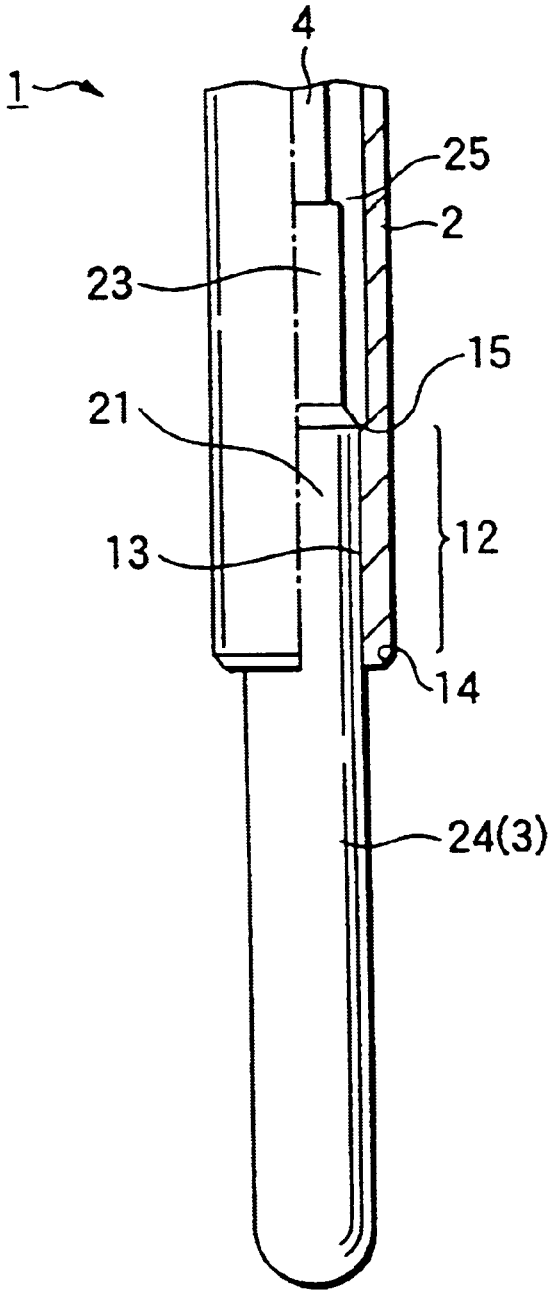
FIG. 4 is a front view, partly in cross section, of the essence of a heating tube according to an embodiment of the invention.
Figure 5:
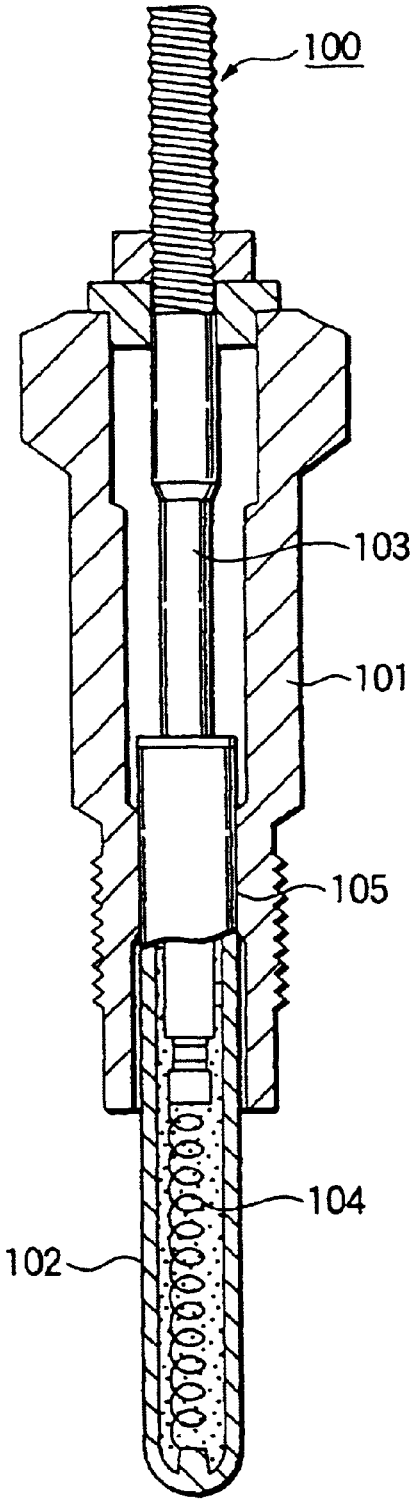
PRIOR ART FIG.5
FIG. 5 is a cross-sectional view showing the conventional glow plug.

The preferred embodiments of the present invention will be described below by way of example using a glow plug. FIG. 1 is a cross-sectional view of the glow plug. FIGS. 2, 3 and 4 are a front view, partly in cross section, of the essence of a heating tube according to the embodiments of the invention.

The glow plug 1 is roughly made up of a cylindrical metal shell 2 extending in an axial direction O, a cylindrical heating tube 3 that is fixed to a top end side of the metal shell 2, with a top end closed, the heating tube 3 extending in the axial direction O, and a center electrode 4 of round pole type. The center electrode 4 is passed through the center of the metal shell 2 to reach the heating tube 3, in which a closed top end of the heating tube 3 and the top end of the center electrode 4 are electrically connected via a control coil and a heating coil, not shown, or via the heating coil alone.

A stepped bore 5 having a larger diameter toward the rear end side is formed in an opening portion 2*b* at the rear end of the metal shell 2. A rear end of the center electrode 4 is supported in the center of the metal shell 3 by a bush-like insulation ring 6 fitted around the stepped bore 5, whereby both are electrically insulated. There is a gap forward of the insulation ring 6 and between the stepped bore 5 and the center electrode 4, in which the gap is closed by an O-ring 7.

On one hand, a tool engaging portion 8 in the form of hexagon head bolt is provided around the outer circumference of a barrel portion at the rear end of the metal shell 2, and a male thread 9 to screw the tool engaging portion 8 with the diesel engine (not shown) is formed in the fore side of the tool engaging portion 8. Also, a screw portion 10 for connecting the power cable (not shown) is formed at a top portion of the center electrode 4, and the insulation ring 6 is pressed by a circular nut 11 to be screwed around the screw portion 10. Though the center electrode 4 and the power cable are electrically connected in this embodiment, a terminal electrode may be provided in the form of covering the top portion of the center electrode 4 to allow the terminal electrode to be fixed to the center electrode 4, whereby the terminal electrode and the power cable may be connected.

The heating tube 3 is a heating portion of the glow plug 1, and made of a conductive metal, with an insulating powder such as magnesia filled inside. In producing the heating portion containing the heating tube 3, after the heating coil alone or both the heating coil and the control coil and the center electrode 4 are inserted into the heating tube 3, and the insulating powder is filled inside, the heating portion is subjected to a swaging process for pressing it front the outer circumference of itself to reduce the diameter, whereby the heating portion with the center electrode 4 integrally provided is fabricated. And the heating tube 3 can be shaped to have a smaller diameter portion through the swaging process.

The metal shell 2 and the heating tube 3 are integrated in interference fit (press-fit). That is, an engagement portion 12 with an aperture restricted is formed inside the metal shell 2. On one hand, the heating tube 3 is formed of a fitting portion 21 fixed to the engagement portion 12 in a state where it is fixed to the metal shell 2 in interference fit (press-fit), and a end portion on base end side 25 that is on the insertion side when inserting the heating tube 3 into the metal shell 2, and comprises a smaller diameter portion 23 having a smaller outer diameter than the inner diameter of the engagement portion 12, a base end side larger diameter side 22 that is formed between the fitting portion 21 and the smaller diameter portion 23 and has an outer diameter greater than or equal to the inner diameter of the engagement portion 12, and a top end side-larger diameter portion 24 that is formed adjacent to the top end side of the fitting portion 21 and has an outer diameter greater than or equal to the inner diameter of the engagement portion 12.

In this embodiment, the inner diameter of the engagement portion 12 for the metal shell 2 is formed at 4.3 mm. In a state before press fitting into the metal shell, the heating tube 3 is formed of a smaller diameter portion 23 containing the base end side end portion 25 a larger diameter portion, located on the top end side of the smaller diameter portion, having an outer diameter larger than the outer diameter of the smaller diameter portion and slightly larger than the inner diameter of the engagement portion 12, and a heating smaller diameter portion 31, located on the top end side of the larger diameter portion, having a smaller diameter than that of the larger diameter portion. At this time, the outer diameter of the smaller diameter portion 23 at the position of the base end side end portion 25 is 4.2 mm, the outer diameter of the larger diameter, portion is 4.4 mm, and the outer diameter of the heating smaller diameter portion 31 is 3.5 mm .

And the heating tube 3 is tightened against the engagement portion 12 due to a diameter difference (4.3 mm−4.4 mm=−0.1 mm) between the outer diameter of the larger diameter portion in the heating tube 3 and the aperture (inner diameter) of the engagement portion 12. At this time, the top end side and the base end side of the larger diameter portion are tightened to protrude from the top end 14 and the base end 15 of the engagement face 13 in the engagement portion 12, respectively (see FIG. 1). The larger diameter portion of the heating tube 3, after press fitting, constitutes the fitting portion 21, the base end side-larger diameter portion 22 and the top end side-larger diameter portion 24, in which the outer diameter of the fitting portion 21 is 4.3 mm, the outer diameter of the base end side-larger diameter portion 22 is 4.4 mm and the outer diameter of the top end side-larger diameter portion 24 is 4.4 mm. Furthermore, the base end side-larger diameter portion 22 is disposed, inside the metal shell 2, in an area within the axial length D of 0.5 mm in the axial direction O from the base end 15 of the engagement face 13 in the engagement portion 12 to the base end side of the heating tube 3.

Since the diameter difference between the inner diameter (4.3 mm) of the engagement portion 12 and the outer diameter (4.2 mm) of the smaller diameter portion at the base end side end portion 25 is 0.1 mm, as described above, it is possible to reduce the resistance in the passage through the engagement portion 12 at the early time of starting to fit the heating tube 3 into the engagement portion 12 of the metal shell 2, and make alignment between the heating tube 3 and the metal shell 2 at high precision.

Herein, the fitting portion 21 of the heating tube 3 has a contact structure from the top end 14 of the engagement face 13 in the engagement portion 12 to the base end 15 (more particularly via the lubricating oil), as shown in FIG. 1. In this structure of fixing the heating tube 3 from the top end 14 of the engagement face 13 in the engagement portion 12 to the base end 15, the press-fit length of the heating tube 3 into the metal shell 2 can be restricted (controlled) depending on the length from the top end 14 of the engagement face 13 to the base end 15, whereby the fixing strength of the heating tube 3 with the metal shell 2 can be securely obtained. To attain the reliable fixing strength of the heating tube 3 with the metal shell 2, it is desirable that the length from the top end 14 of the engagement face 13 in the engagement portion 12 to the base end 15 is set at 4.0 mm or greater (preferably with an upper limit value of 20 mm or less), when the outer diameter of a portion of the heating tube 3 fixed with the engagement portion 12 formed in the metal shell 2 is from 3.5 to 7.0 mm. Specifically, in this embodiment, the outer diameter of the portion of the heating tube 3 fixed with the engagement portion 12 is set at 4.4 mm, and the length from the top end 14 of the engagement face 13 in the engagement portion 12 to the base end 15 is set at 5.0 mm. In this specification (present invention), the phrase "the engagement face in the engagement portion" means a portion (face) fixed (contacted) with the outer circumferential face of the heating tube 3.

In the glow plug 1 of this embodiment, the smaller diameter portion 31 for heating that is provided on the top end side of the heating tube 3 has a reduced diameter as compared with the outer diameter of the fitting portion 21. Thereby, the top end side of the heating tube 3 is prone to heating, and the glow plug 1 superior in the temperature up performance at the early time can be obtained.

Thus, in this glow plug 1, the heating tube 3 is fixed to the engagement face 13 in the engagement portion 12, and the base end side of the heating tube 3 is passed through the engagement portion 12 to protrude into the metal shell 2, in which the smaller diameter portion 21 having an outer diameter smaller than the inner diameter of the engagement portion 12 is provided in its protruding portion. In the above example, the inner diameter of the engagement portion 12 is 4.3 mm, and the outer diameter of the smaller diameter portion 23 at the position of the base end side end portion 25 is 4.2 mm. With this constitution, when the heating tube 3 is fitted into the metal shell 2, the protruding portion of the heating tube 3 has little resistance, and passes through the engagement portion 12, in which a portion of the heating tube 3 engaged by the engagement portion 12 is only press fit. Accordingly, because the press-fit load is not increased more than necessary, the heating tube itself is suppressed or prevented from being bent, even in the case where the heating tube 3 is slender. Since the time and distance for press fitting the heating tube 3 into the engagement portion 12 of the metal shell 2 can be shortened to the minimum as needed, there is less dispersion in the frictional force occurring with the engagement portion 12, and in the press-fit load, resulting in the easier controllability. The effect of reducing the dispersion in the press-fit load has been confirmed by a test of fitting the heating tube 3 into the metal shell 2, as conducted by applicants of this application.

In a specific form, the heating tube 3 is made slender from a base end of the base end side-larger diameter portion 22 in the metal shell 2 to uniform thickness to provide the smaller diameter portion 23, as shown in FIG. 1, or may be tapered from a base end of the base end side-larger diameter portion 22 to the base end side end portion 25 of the heating tube 3 to provide the smaller diameter portion 23, as shown in FIG. 2. Also, the heating tube 3 may have uniform thickness from the closed top end to the fitting portion 21 fitted into the engagement portion 12 of the metal shell 2, as shown in FIG. 3. The adjustment of the outer diameter of the heating tube 3 can be made by appropriately adjusting the pressure applied on the heating tube 3 using a stamping die in the swaging process, when the heating tube 3 is made of metal. Furthermore, the heating tube 3 may have the smaller diameter portion 23 from the base end 15 of the engagement face 13 in the engagement portion 12 to the base end side end portion 25 of the heating tube 3, as shown in FIG. 4. In the heating tube 3 of the above forms, in order to effectively suppress the resistance in the passage through the engagement portion 12 at the early time of fitting the heating tube 3 into the engagement portion 12 of the metal shell 2, the diameter difference between the inner diameter of the engagement portion 12 and the outer diameter of the smaller diameter portion 23 at the base end side end portion 25 is set in a range from 0.02 to 0.5 mm.

Though the glow plug 1 according to the embodiment of the invention has been described above, the invention is also applicable to the heats such as a water heater for heating a heating object such as the gas or liquid.

The entire disclosure of each and every foreign patent application from which the benefit of foreign priority has been claimed in the present application is incorporated herein by reference, as if fully set forth.

What is claimed is:

1. A heater comprising:

a cylindrical metal shell having an engagement portion, the portion having a narrowed diameter;

a cylindrical heating tube comprising a closed top end, a fitting portion, a smaller diameter portion, a base end side-larger diameter portion and a top end side-larger diameter portion, wherein a base end of the heating tube protrudes into an inside of the metal shell, the fitting portion is fitted into the engagement portion in interference fit, the smaller diameter portion comprises the base end of the heating tube, the smaller diameter portion has a smaller outer diameter than an inner diameter of the engagement portion, the base end side-larger diameter portion is formed between the fitting portion and the smaller diameter portion, the base end side-larger diameter portion has an outer diameter larger than or equal to the inner diameter of the engagement portion, the top end side-larger diameter portion is formed adjacent to a top end side of the fitting portion, and the top end side-larger diameter portion has an outer diameter larger than or equal to the inner diameter of the engagement portion.

2. The heater according to claim 1, wherein the base end side-larger diameter portion is disposed, inside the metal shell, in an area with an axial length of 2 mm or less in an axial direction from a base end of an engagement face in the engagement portion to the base end side of the heating tube, the engagement face being in contact with the fitting portion.

3. The heater according to claim 1, wherein an outer diameter of the fitting portion is from 3.5 to 7.0 mm, the engagement portion has an engagement face being in contact with the fitting portion, and the engagement face has a length of 4.0 mm or greater in an axial direction.

4. The heater according to claim 1, wherein a diameter difference between an inner diameter of the engagement portion and an outer diameter of an end portion on the base end side in the smaller diameter portion lies in a range from 0.02 to 0.5 mm.

5. A glow plug comprising:

a cylindrical metal shell having an engagement portion, the portion having a narrowed diameter;

a cylindrical heating tube comprising a closed top end, a fitting portion, a smaller diameter portion, a base end side-larger diameter portion and a top end side-larger diameter portion, wherein a base end of the heating tube protrudes into an inside of the metal shell, the fitting portion is fitted into the engagement portion in interference fit, the smaller diameter portion comprises the base end of the heating tube, the smaller diameter portion has a smaller outer diameter than an inner diameter of the engagement portion, the base end side-larger diameter portion is formed between the fitting portion and the smaller diameter portion, the base end side-larger diameter portion has an outer diameter larger than or equal to the inner diameter of the engagement portion, the top end side-larger diameter portion is formed adjacent to a top end side of the fitting portion, and the top end side-larger diameter portion has an outer diameter larger than or equal to the inner diameter of the engagement portion.

6. The glow plug according to claim 5, wherein the base end side-larger diameter portion is disposed, inside the metal shell, in an area with an axial length of 2 mm or less in an axial direction from a base end of an engagement face in the engagement portion to the base end side of the heating tube, the engagement face being in contact with the fitting portion.

7. The glow plug according to claim 5, wherein an outer diameter of the fitting portion in from 3.5 to 7.0 mm, the engagement portion has an engagement face being in contact with the fitting portion, and the engagement face has a length of 4.0 mm or greater in an axial direction.

8. The glow plug according to claim 5, wherein a diameter difference between an inner diameter of the engagement portion and an outer diameter of an end portion on the base end side in the smaller diameter portion lies in a range from 0.02 to 0.5 mm.

9. A heater comprising:

a cylindrical metal shell having an engagement portion, the portion having a narrowed diameter;

a cylindrical heating tube comprising a closed top end, a fitting portion, a smaller diameter portion and a top end side-larger diameter portion, wherein a base end of the heating tube protrudes into an inside of the metal shell, the fitting portion is fitted into the engagement portion in interference fit, the smaller diameter portion comprises the base end of the beating tube, the smaller diameter portion has a smaller outer diameter than an inner diameter of the engagement portion, the top end side-larger diameter portion is formed adjacent to a top end side of the fitting portion, the top end side-larger diameter portion has an outer diameter larger than or equal to the inner diameter of the engagement portion, and a diameter difference between an inner diameter of the engagement portion and an outer diameter of an end portion on the base end side in the smaller diameter portion lies in a range from 0.02 to 0.5 mm.

10. A glow plug comprising:

a cylindrical metal shell having an engagement portion, the portion having a narrowed diameter;

a cylindrical heating tube comprising a closed top end, a fitting portion, a smaller diameter portion and a top end side-larger diameter portion, wherein a base end of the heating tube protrudes into an inside of the metal shell, the fitting portion is fitted into the engagement portion in interference fit, the smaller diameter portion comprises the base end of the heating tube, the smaller diameter portion has a smaller outer diameter than an inner diameter of the engagement portion, the top end side-larger diameter portion is formed adjacent to a top end side of the fitting portion, the top end side-larger diameter portion has an outer diameter larger than or equal to the inner diameter of the engagement portion, and a diameter difference between an inner diameter of the engagement portion and an outer diameter of an end portion on the base end side in the smaller diameter portion lies in a range from 0.02 to 0.5 mm.

* * * * *